US005791953A

United States Patent [19]

Gunderson et al.

[11] Patent Number: 5,791,953

[45] Date of Patent: Aug. 11, 1998

[54] SHUTTER VALVE FOR A MARINE ENGINE

[75] Inventors: Dennis R. Gunderson; Matthew W. Jaeger; Arthur L. Barker; Charles E. Wright; Darrin L. Doty; Kenneth C. Grainger, all of Stillwater, Okla.

[73] Assignee: Brunswick Corporation, Lake Forest, Ill.

[21] Appl. No.: 786,864

[22] Filed: Jan. 23, 1997

[51] Int. Cl.[6] ..... F01N 3/00

[52] U.S. Cl. ..... 440/89; 60/324

[58] Field of Search ..... 440/88, 89; 60/324; 181/237, 227

[56] References Cited

U.S. PATENT DOCUMENTS 4,178,873 12/1979 Bankstahl ..... 440/89
4,773,215 9/1988 Winberg et al. ..... 440/89
4,787,869 11/1988 Shiozawa ..... 440/89
4,993,876 2/1991 Zemlicka ..... 60/324
5,355,673 10/1994 Sterling et al. ..... 60/324

*Primary Examiner*—Jesus D. Sotelo
*Attorney, Agent, or Firm*—Andrus, Sceales, Starke & Sawall

[57] ABSTRACT

A shutter valve construction for the exhaust system of a marine engine that discharges exhaust underwater. The valve construction includes an adaptor having an annular body that is adapted to be engaged in the end of an exhaust pipe. Opposite sides of the body are provided with outwardly projecting bosses which are received within holes in the exhaust pipe to position the adaptor relative to the pipe. The valve construction also includes a butterfly-type shutter valve that consists of a pair of valve members which are hinged to a hinge pin that is removably connected to the adaptor. To connect the valve to the adaptor, the ends of the hinge pin extend into opposed openings in the body of the adaptor and receive resilient grommets.

14 Claims, 3 Drawing Sheets

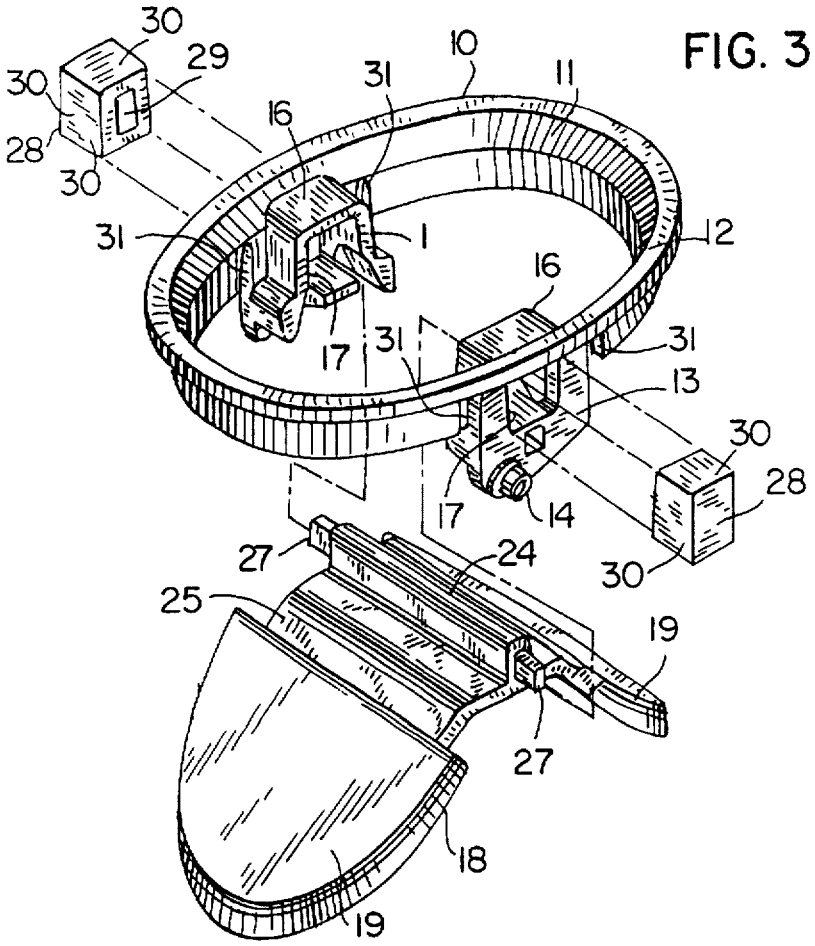
FIG. 3
FIG. 4
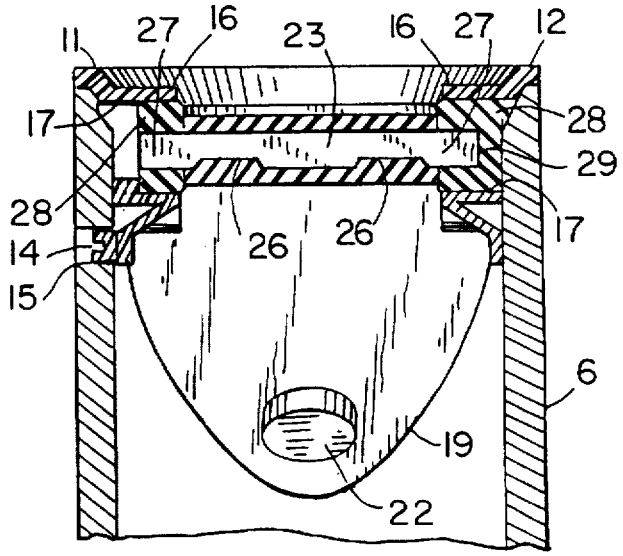

SHUTTER VALVE FOR A MARINE ENGINE

BACKGROUND OF THE INVENTION

In a marine stern drive engine, the water cooled engine is located inboard, and is coupled to an outboard drive unit that is mounted on the transom of the boat. The engine exhaust system of the typical stern drive unit includes a pair of exhaust manifolds mounted on the engine, and each manifold carries a manifold exhaust elbow that is connected through an intermediate exhaust elbow to the upper end or leg of a Y-shaped lower exhaust pipe. The stem portion of the exhaust pipe is coupled to the outboard drive unit so that the exhaust is discharged from the exhaust pipe through the propeller hub to a location beneath the water surface.

As the exhaust system terminates beneath water level, the typical stern drive exhaust system includes a shutter valve to prevent water from entering the engine through the exhaust passageway. The typical shutter valve is a check valve which permits the exhaust to freely be discharged through the exhaust pipe to the drive unit, while preventing inward movement of water into the exhaust system.

U.S. Pat. No. 4,498,876 describes a shutter valve for a marine engine, which acts to prevent water from entering the engine through the exhaust passageway. According to that patent, a shutter valve is mounted in each upper leg of the exhaust pipe and each valve consists of a generally flat metal plate covered with an elastomeric material such as a silicone rubber. The shutter valve is mounted for movement between open and closed positions on a hinge pin which extends diametrically across the exhaust pipe.

The shutter valve of the aforementioned patent is shaped to close the exhaust pipe at an angle of approximately 60° from the vertical and is balanced to normally hang open at an angle of about 38° from the vertical. As the shutter valve of that patent is normally not closed in the absence of flow, the back pressure to the engine is substantially reduced.

SUMMARY OF THE INVENTION

The invention is directed to an improved shutter valve assembly for a marine stern drive engine, and more particularly to a shutter valve assembly that can be used as original equipment or can be retrofitted as a replacement for existing shutter valve assemblies.

The shutter valve construction of the invention comprises an adaptor having a generally oval shaped body that is adapted to be engaged with an upstream end of the exhaust type. A pair of legs extend downwardly from the body of the adaptor, and carry generally cylindrical, outwardly extending bosses that fit within diametrically opposed holes in the exhaust pipe.

The valve construction also includes a butterfly type valve that is mounted on the adaptor. The valve includes a pair of valve members, each of which is composed of a generally flat metal plate or insert coated with an elastomeric material, such as neoprene rubber. The two valve members are connected to a hinge pin through a pair of integral elastomeric hinges. To connect the valve to the adaptor, each end of the hinge pin is received within a recess in a resilient grommet and the grommets, in turn, are mounted in diametrically opposite openings in the body of the adaptor, thus locking the hinge pin to the adaptor.

The valve members are designed with a configuration such that the valve members, when in a closed position, will engage the inner wall of the exhaust pipe and are located at an angle of about 60° to the vertical. When the valve members are in the full open position, the valve members are substantially vertical and parallel to each other.

In operation of the engine, the flow of exhaust gas will pivot the valve members downwardly about the hinge pin, permitting the exhaust gas to flow to the drive unit and be discharged under water. During the portion of the cycle when the exhaust ports in the engine are closed, the valve members will be drawn upwardly to a closed position, to thereby prevent water from being drawn to the engine.

The shutter valve construction of the invention can be retrofitted to replace existing shutter valves without modification or alteration of the exhaust system. To retrofit the shutter valve, the butterfly shutter valve is initially installed with the adaptor by positioning the ends of the hinge pin in the large openings in opposite sides of the adaptor body and then inserting the grommets in the outer ends of the openings to capture the hinge pin ends. The adaptor with the attached valve in the fully open position is then inserted in the end of the exhaust pipe, and by manually deforming the adaptor body, the bosses on the adaptor legs are engaged with the diametrically opposite holes in the pipe that were previously employed to receive the hinge pin of the original shutter valve.

Due to the metal insert, the valve members are extremely durable and the elastomeric coating on the peripheral edge of the valve members provides a positive seal to the exhaust pipe.

Other objects and advantages will appear during the course of the following description.

DESCRIPTION OF THE DRAWINGS

The drawings illustrate the best mode presently contemplated of carrying out the invention.

In the drawings:

FIG. 3 is an exploded view of the shutter valve construction;

FIG. 4 is a section taken along line 4—4 of FIG. 2;

DESCRIPTION OF THE ILLUSTRATED EMBODIMENT

Figure 1:
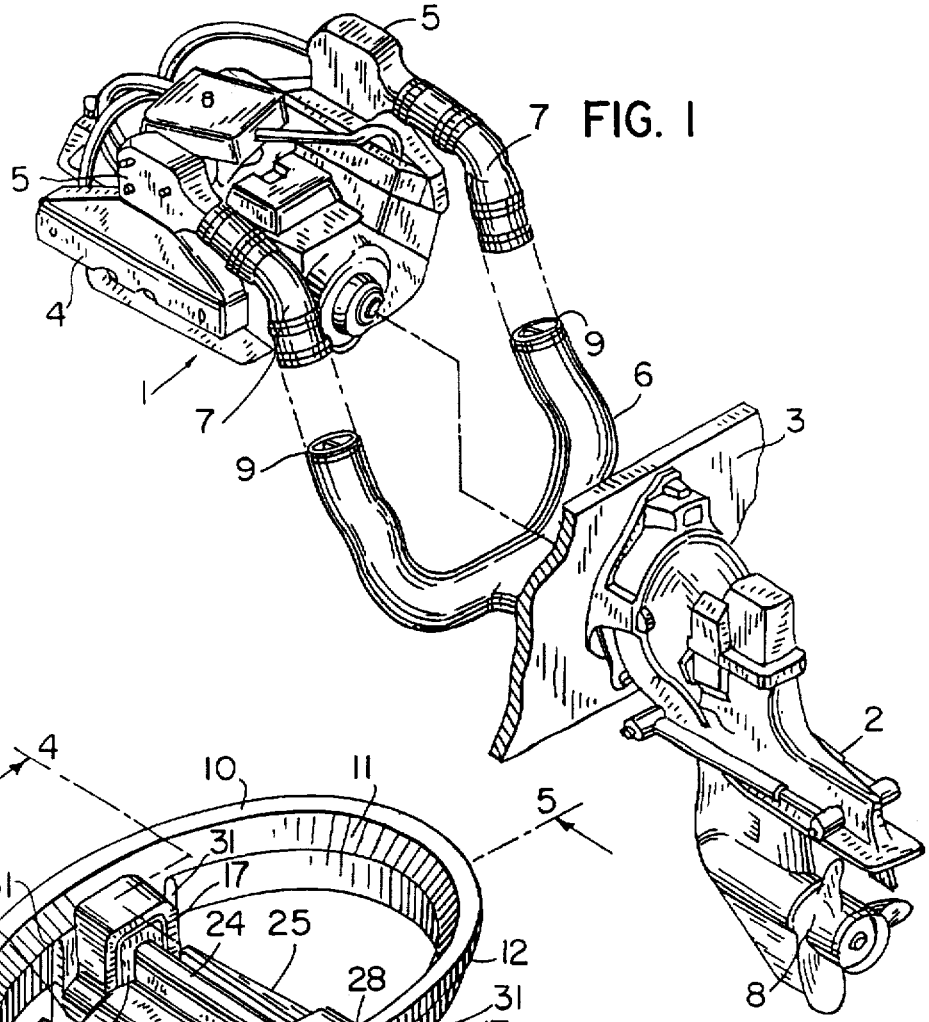
FIG. 1 is a exploded perspective view of a marine stern drive incorporating the invention.

FIG. 1 illustrates a marine stern drive including a water cooled marine engine 1 that is operably connected to an outboard drive unit 2 mounted on the transom 3 of a boat.

Engine 1 includes an exhaust system having a pair of exhaust manifolds 4 mounted on the engine, and an exhaust manifold elbow 5 is mounted on each manifold 4. A generally Y-shaped exhaust pipe 6 has each of its upper ends or legs connected to an intermediate exhaust elbow 7 which in turn is coupled to a manifold elbow 5. The lower end of the exhaust pipe 6 is connected to the drive unit 2 in a manner to discharge the exhaust gases through the propeller hub 8 beneath the level of the water.

In accordance with the invention, a shutter valve assembly 9 is mounted in the upper end of each leg of exhaust pipe 6. Each valve assembly 9 permits free flow of exhaust through the exhaust pipe 6 to drive unit 2, while preventing flow of water in the opposite direction.

Figure 2:
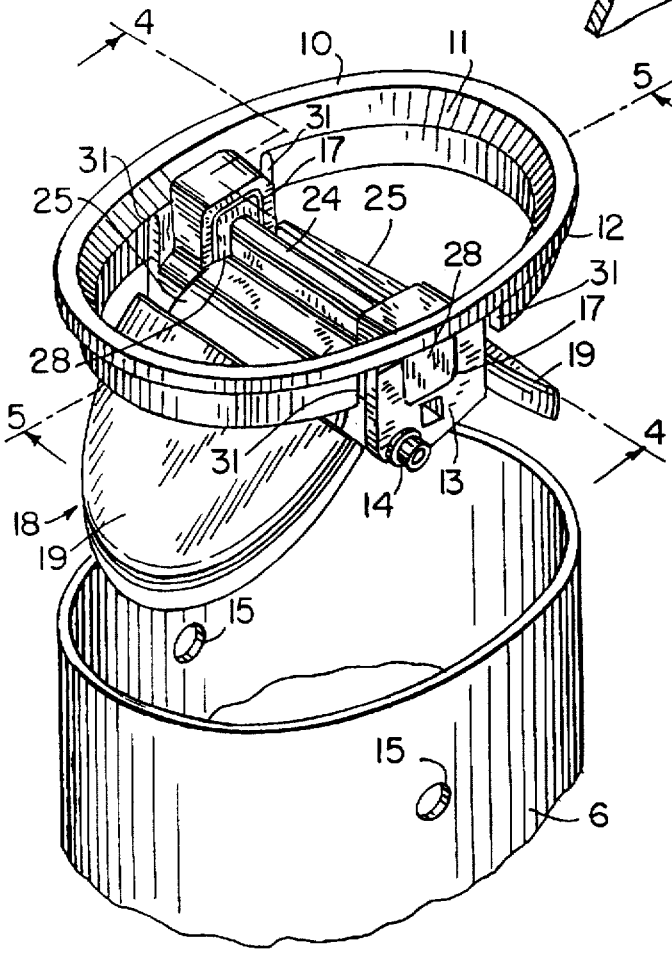
FIG. 2 is an enlarged exploded view of the shutter valve construction and exhaust pipe.

As can best be seen in FIGS. 2 and 3, each valve assembly 9 includes an adaptor 10 having a generally oval shaped body 11, that terminates in an outwardly extending peripheral flange 12 that is engaged with the upper end of the exhaust pipe 6. In practice, the adaptor 10 is preferably composed of a thermoplastic material, such as 30% glass reinforced nylon.

Extending downwardly from opposite sides of body 11 are legs 13, and the lower end of each leg carries an outwardly extending, generally cylindrical boss 14, and the bosses are engaged with holes 15 in exhaust pipe 6, thus mounting body 11 of adaptor 9 to pipe 6.

Opposite sides of body 11 of adaptor 9 are provided with inwardly extending abutments 16 and openings 17 extend through the abutments as well as through body 11.

Figure 5:
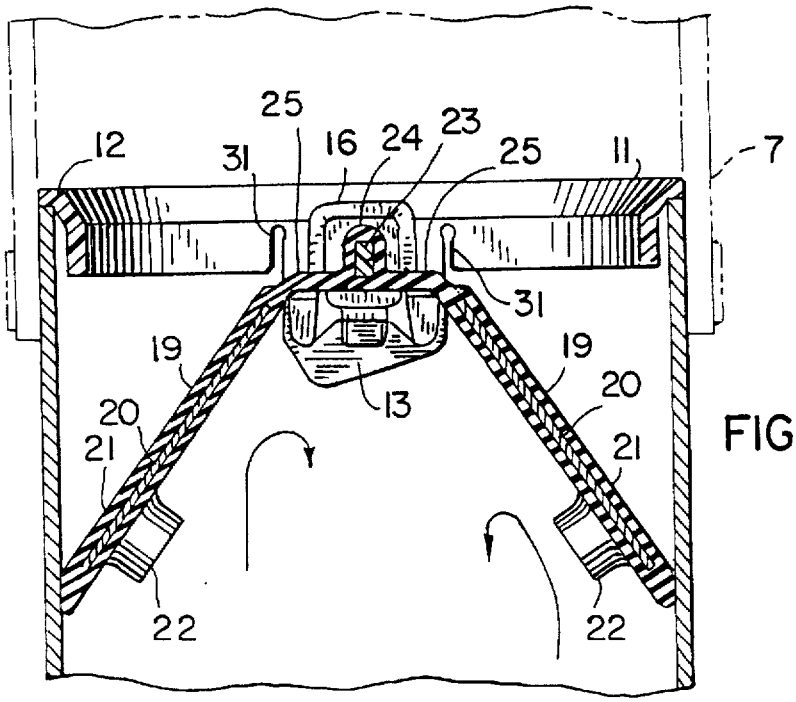
FIG. 5 is an enlarged section taken along lines 5—5 of FIG. 2; and showing the valve members in an closed position.

A butterfly-type valve 18 is mounted on adaptor 10. Valve 18 includes a pair of generally flat valve members 19, each of which is composed of a flat, stainless steel plate 20 covered with an elastomeric material 21, such as neoprene rubber. The periphery of the metal plate 20 terminates inwardly of the periphery of the elastomeric covering 21, so that the peripheral edge of each valve member 19 is flexible and resilient, and is adapted to sealingly engage the inner surface of pipe 6 when the valve member 19 is in the closed position, as shown in FIG. 5.

Figure 6:
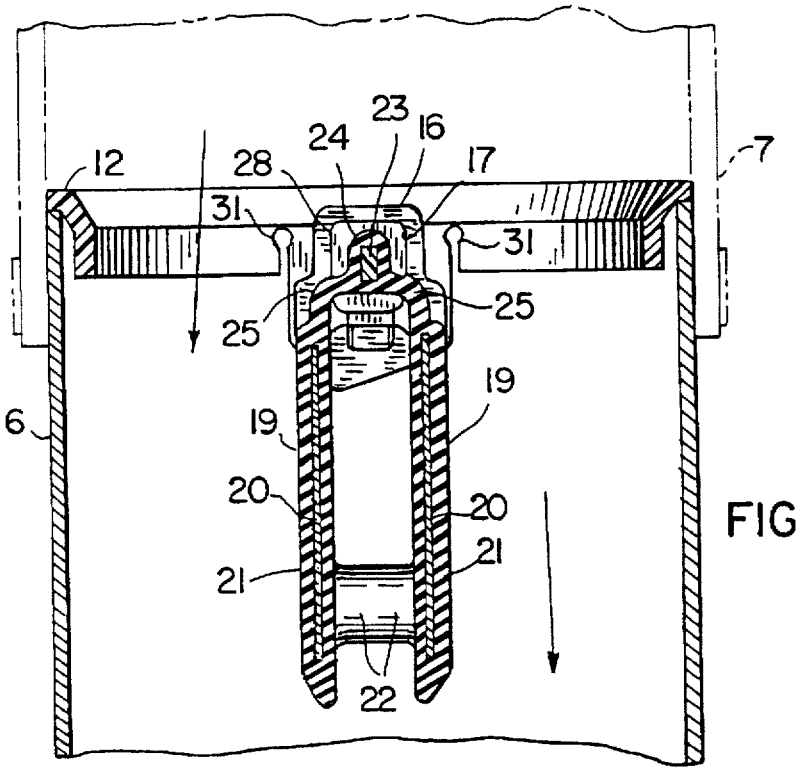
FIG. 6 is a view similar to FIG. 5 showing the valve members in the open position.

The underside of one or both of the valve members 19 can be provided with a lug 22. Engagement of the lugs 22 will serve to position the valve members 19 in the full open position, as seen in FIG. 6.

Valve members 19 are mounted for pivoting movement about a central hinge pin 23, that extends transversely across adaptor 10. An elastomeric coating 24 is applied to hinge pin 23 and merges with the elastomeric coating 21 on of the valve members via hinge areas 25. The areas 25 are flexible and provide integral hinges connecting each valve member 19 with hinge pin 23. As best shown in FIG. 4, pin 23 can be formed with one or more notches 26, and when the elastomeric material 24 is molded around the hinge pin, the elastic material will fill the notches 26, thus mechanically locking the elastomeric material 24 to pin 23.

As best shown in FIG. 4, the outer projecting ends 27 of pin 23 are received within openings 17 of adaptor 10 and sealed in the openings by resilient grommets 28, formed of a material such as neoprene rubber. Each grommet 28, which is wedged into the outer end of the respective opening 17, is provided with a central recess 29 that receives end 27 of hinge pin 23. As best shown in FIG. 3, the outer side surfaces 30 of each grommet 28 are generally flat and when the grommet is driven into the opening 17, the resilient grommet will be compressed inwardly to provide a firm seal to the hinge pin end 27.

The valve unit of the invention has particular application as a replacement for worn shutter valves, such as a shutter valve of the type shown in U.S. Pat. No. 4,498,876. With the construction of that patent, the ends of the pivot shaft that carries the plate-like valve member are mounted in diametrically opposed openings, such as shown by 15, in the exhaust pipe.

To install the valve assembly 9 as a retrofit, the upper legs of exhaust pipe 6 are disconnected from the intermediate exhaust elbows 7 and the original shutter valves are removed from the legs of the exhaust pipe by disengagement of the pivot shaft of each valve from the holes 15 in the exhaust pipe 6.

The shutter valve unit 9 of the invention is then assembled by initially connecting the valve members 19 to adaptor 10. This is accomplished by positioning the ends 24 of hinge pins 23 in openings 17 of the adaptor and then driving the resilient grommets 28 into the outer ends of openings 17 to cause the pin ends 24 to be received in the recesses 29 of the grommets, thus firmly positioning the hinge pin 23 and valve members to the body 11 of adaptor 10. Grommets 28 provide a multiple function in that they not only serve to connect the valve 18 to the adaptor, but also provide a seal to the ends of the shaft or pin 23 and act to cushion vibration during open and closed operation of the valve.

After connection of the valve 18 to adaptor 10, the assembly, with the valve in the fully open position, is attached to the end of pipe 6 by inserting the body 11 into the pipe end and manually deforming the body 11 inwardly to enable bosses 14 to ride along the inside of pipe 6 and then snap into holes 15. Body 11 is provided with a group of open-ended slots 31 to facilitate the deformation of the body as bosses 14 are inserted in holes 15.

The shutter valve unit of the invention can be employed to replace existing worn shutter valves, or can be used as original equipment. When used as a retrofit, it can be installed without modification or alteration of the exhaust system.

The shutter valve 21 is more durable than shutter valves as used in the past, which substantially extends the service life of the valve.

The engagement of the resilient peripheral edge of the valve members 19 with the inner wall of the exhaust pipe 6 provides a seal when the valve members are in the closed position to prevent water from entering the engine.

We claim:

1. In a stern drive for a boat, an inboard engine, an outboard drive unit operably connected to the engine, an exhaust passageway connected to the engine and having a discharge end for discharging exhaust gas below the surface of the water on which the boat is operating, said exhaust passageway including an exhaust pipe, a valve unit including an annular adaptor connected to an end of the exhaust pipe, valve means mounted on the adaptor and including a valve member and a transverse shaft, said valve member being hinged to said shaft and movable between a closed position where said valve member closes off said exhaust pipe to an open position, and resilient connecting means for connecting each end of said shaft to said adaptor.

2. The stern drive of claim 1, wherein said exhaust pipe has a pair of holes located in spaced relation to said end of the pipe, and said adaptor has a pair of outwardly extending bosses each received in one of said holes.

3. The stern drive of claim 2, wherein said adaptor includes a generally annular body disposed to fit in sealing engagement with said end of the exhaust pipe, said adaptor having a pair of downwardly extending legs, said bosses being disposed on said legs.

4. The stern drive of claim 1, and including a pair of said valve members each hinged to said shaft.

5. The stern drive of claim 4, wherein each valve member includes a generally flat metal insert, and an outer elastomeric covering.

6. The stern drive of claim 4, and including an elastomeric hinge connecting each valve member to said shaft.

7. The stern drive of claim 6, and including a coating of an elastomeric material on said shaft and merging with said elastomeric hinges.

8. The stern drive of claim 1, wherein said resilient connecting means comprises a grommet disposed in an opening in said adaptor and having an inwardly facing recess to receive an end of said shaft.

9. The stern drive of claim 8, wherein the opening in said adaptor extends completely through the adaptor and said grommet is constructed and arranged to be inserted into an outer end of said opening to effect engagement of said recess with the end of said shaft.

10. The stern drive of claim 9, wherein said grommet in an uncompressed state has flat side walls.

11. The stern drive of claim 10, wherein each opening in the adaptor is bordered by a first pair of opposed parallel walls and a second pair of opposed parallel walls.

12. In a marine stern drive, an inboard engine, an outboard drive unit operably connected to said engine, an exhaust passageway connected to said engine and having a discharge end for discharging exhaust gas below the surface of water on which the boat is operating, said exhaust passageway including an exhaust pipe having an end and having a pair of opposed holes disposed adjacent said end, a valve assembly including an annular adaptor mounted to said end of said exhaust pipe and having a pair of downwardly extending legs, a boss extending radially outward from each leg, each boss received in one of said holes, valve means including a transverse pivot shaft and a pair of valve members located on either side of said shaft, each valve member including a generally flat metal insert and an outer elastomeric covering, an elastomeric hinge integrally connecting the elastomeric covering on each valve member with said pivot shaft, said hinges permitting movement of said valve members from a closed position where said valve members close off said exhaust pipe to an open position, and resilient connecting means for connecting each end of said shaft to said adaptor.

13. The stern drive of claim 12, wherein said valve members are identical in size and shape.

14. The stern drive of claim 12, wherein each valve member has a peripheral edge disposed to engage an inner surface of said exhaust pipe when said valve members are in the closed position.

* * * * *